US005360059A

United States Patent [19]

Olson

[11] Patent Number: 5,360,059

[45] Date of Patent: Nov. 1, 1994

[54] FRAME FOR A VEHICULAR RADIATOR

[75] Inventor: Gregg D. Olson, Racine, Wis.

[73] Assignee: Modine Manufacturing Company, Racine, Wis.

[21] Appl. No.: 254,035

[22] Filed: Oct. 6, 1988

[51] Int. Cl.[5] ..... F28D 1/00

[52] U.S. Cl. ..... 165/149; 165/67

[58] Field of Search ..... 165/67, 149, 906; 180/68.4

[56] References Cited

U.S. PATENT DOCUMENTS

| | | | |
|---|---|---|---|
| 2,065,515 | 12/1936 | Cornell, Jr. | 165/149 X |
| 4,382,464 | 5/1983 | Melnyk | 165/76 |
| 4,540,044 | 9/1985 | Lenz | 165/149 |
| 4,619,313 | 10/1986 | Rhodes et al. | 165/67 |

FOREIGN PATENT DOCUMENTS

| | | | |
|---|---|---|---|
| 1939135 | 5/1980 | Germany | 165/149 |

*Primary Examiner*—Martin P. Schwadron

*Assistant Examiner*—Allen J. Flanigan

*Attorney, Agent, or Firm*—Wood, Dalton, Phillips, Mason & Rowe

[57] ABSTRACT

The high cost of providing a heavy duty radiator is minimized in a radiator having a core and tank assembly 22 including a heat exchanger core 24, a pair of spaced headers 26, 28, a pair of spaced side pieces 34 on each side of the core 24, and a pair of tanks 36, 38 secured to respective ones of the headers 26, 28. A separate rectangular frame is provided for the core and tank assembly 22 and is made up of two each of first and second channels, 10, 12; 14, 16 with the first channels 10, 12 being substantially identical and the second channels 14, 16 being substantially identical. The first channels 10, 12, are disposed at opposite ends of the core and tank assembly 22 and encompass corresponding ones of the tanks 36, 38 while the second channels 14, 16 fit about the side pieces 34 and tightly embrace the same to provide pressure resistance.

11 Claims, 5 Drawing Sheets

FRAME FOR A VEHICULAR RADIATOR

FIELD OF THE INVENTION

This invention relates to heat exchangers such as radiators for cooling engine coolant and which are utilized in environments wherein they are subjected to substantial vibration and both pressure and thermal cycling as, for example, in a heavy duty truck or the like.

BACKGROUND OF THE INVENTION

Radiators are conventionally employed to cool the coolant for liquid cooled engines and most frequently are found in vehicles. In typical vehicle usage, the engines are turned off and on and when so cycled, go from an ambient or relatively cool temperature to an operating temperature and back. And of course, as the engine is intended to propel the vehicle, the vehicle will move the engine and the radiator over the underlying terrain.

The cycling that goes with turning an engine on and off provides severe strain on the radiator. As the coolant heats up following initiation of operation of the engine, the pressure within the coolant system increases. When the engine is turned off and the coolant begins to cool, the pressure will begin to decrease. This of course means that various radiator components are subjected cyclically to varying pressure and must be capable of repeatably withstanding such cycling.

The off-on cycling of the engine also thermally stresses the radiator components. In particular, as coolant temperature increases or decreases, radiator components in thermal contact therewith will expand or contract and the since the expansion and contraction is generally not uniform across the entire radiator, thermally induced stresses will occur.

Needless to say, the vibration that is involved as a vehicle traverses the underlying terrain also physically stresses all parts of the vehicle, including the coolant system and the radiator therein.

In order to both minimize weight as well as to maximize thermal efficiency and minimize component cost, fins and tubes employed in radiators are made as thin as possible. This of course reduces their physical strength. Given the stresses that appear in the environment in which the radiator is used, it is necessary that there be some means of support for the radiator and its components.

Heretofore, conventional radiators to be used in heavy duty vehicular applications have been known as "bolted radiators". In these constructions, metallic tanks also act as frame members and are bolted by as many as fifty or more bolts to each of the two headers of a radiator core and side pieces, with or without one or more additional frame members which may be employed to locate the headers with respect to one another and to strengthen the assembly against failure induced by thermal cycling. In plate fin constructions, the plate fins provide support against pressure cycling failure. Where lesser cost serpentine fins are used, the problem of pressure cycling failure remains. Vibration in the environment of use is always a concern.

While such constructions work well for their intended purposes, they are difficult to assemble because of the many bolts required and leakage at the header to tank interfaces can be a problem. Moreover, the constructions do not provide a great deal of flexibility in terms of allowing one type of unit to serve a variety of differing vehicles without substantial modification The present invention is directed to overcoming one or more of the above problems.

SUMMARY OF THE INVENTION

It is the principal object of the invention to provide a new and improved heavy duty radiator construction. More specifically, it is an object of the invention to provide such a radiator that is strong and durable and yet is made up of a minimal number of differing parts which are easily assembled and which provide design flexibility.

An exemplary embodiment of the invention achieves the foregoing object in a heavy duty radiator which includes a core and tank structure. The core and tank structure is made up of a heat exchanger core having the shape of a rectangular solid, a pair of spaced headers, one on each end of the core, a pair of spaced side pieces, one on each side of the core and extending between the headers, and a pair of tanks, one secured to each of the headers. A separate rectangular frame is provided for the tank and core assembly and the frame comprises two each of first and second channels. The first channels are disposed at opposite ends of the tank and core assembly and encompass corresponding ones of the tanks. The second channels fit about the sides of the core and embrace the corresponding side pieces to provide pressure resistance to the sides of the core. First fasteners secure the second channels to the first channels and second fasteners secure the second channels to the tanks.

In a preferred embodiment of the invention, the two first channels are substantially or even completely identical one to the other.

According to the invention, the second channels are substantially or completely identical one to the other.

In a preferred embodiment of the invention, the first channels are identical to each other and the second channels are also identical to each other.

In a highly preferred embodiment, gussets integral with at least two of the channels are disposed at the corners of the frame and interconnect respective channels at each such corner.

For ease of economical manufacture, the channels are stamped sheet metal.

The invention also contemplates that the tanks may be identical.

In a highly preferred embodiment, the gussets are integral with the second channels and are located at each end thereof and are thus secured to the first channels by the first fasteners.

The invention contemplates that the gussets have open centers to minimize obstruction to air flow through the heat exchanger core.

In a preferred embodiment, the second fasteners are threaded fasteners that extend through the second channels to the ends of the tanks.

Other objects and advantages will become apparent from the following specification taken in connection with the accompanying drawings.

DESCRIPTION OF THE PREFERRED EMBODIMENT

Figure 1:
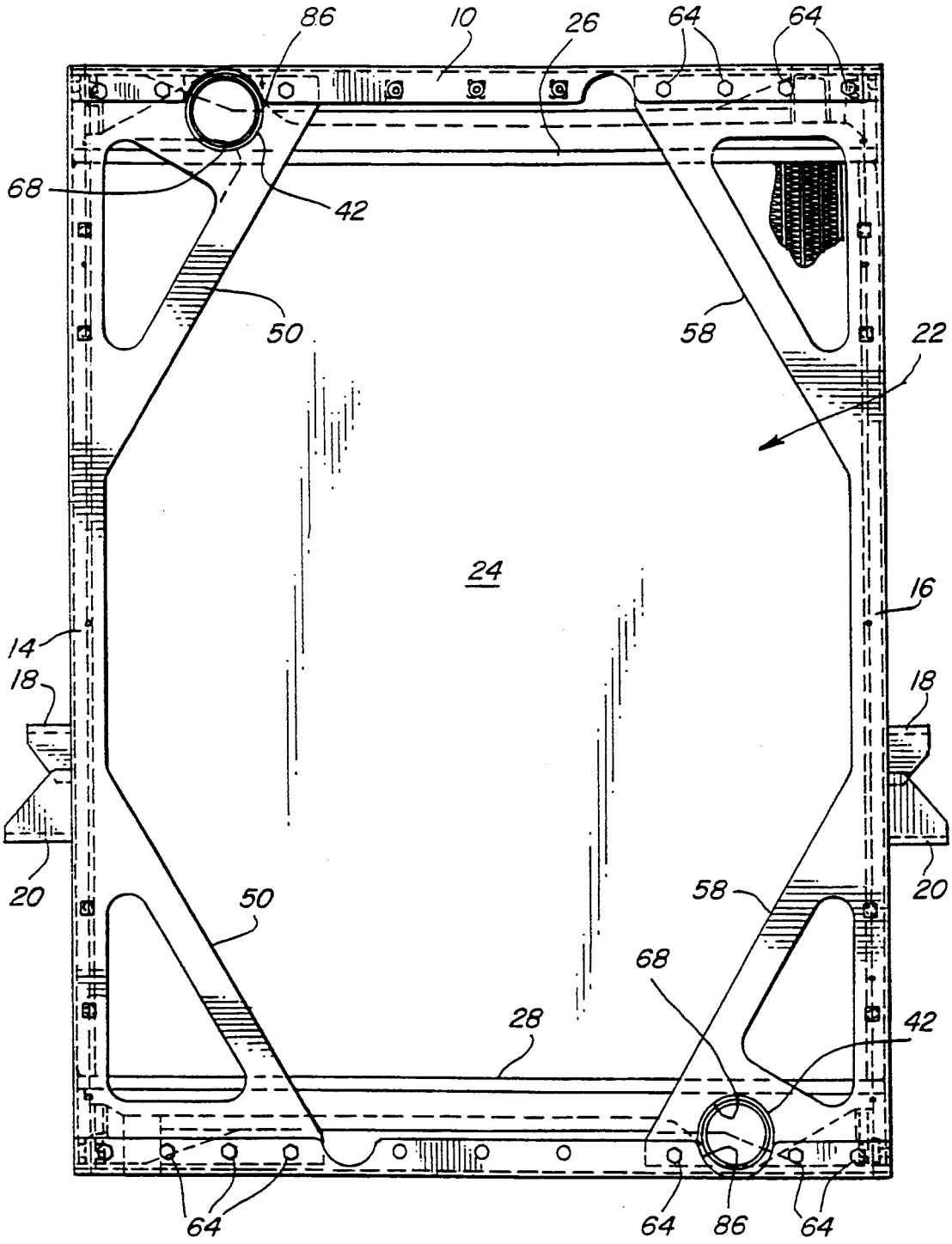
FIG. 1 is a rear elevation of a heavy duty radiator made according to the invention.

An exemplary embodiment of a heavy duty heat exchanger or radiator made according to the invention is illustrated in the drawing. A completed assembly is illustrated in FIGS. 1 and 2 and is seen to include a generally rectangular frame made up of substantially identical top and bottom cross members, 10 and 12 respectively, interconnected by substantially identical left and right side channels 14 and 16 respectively.

Figure 2:
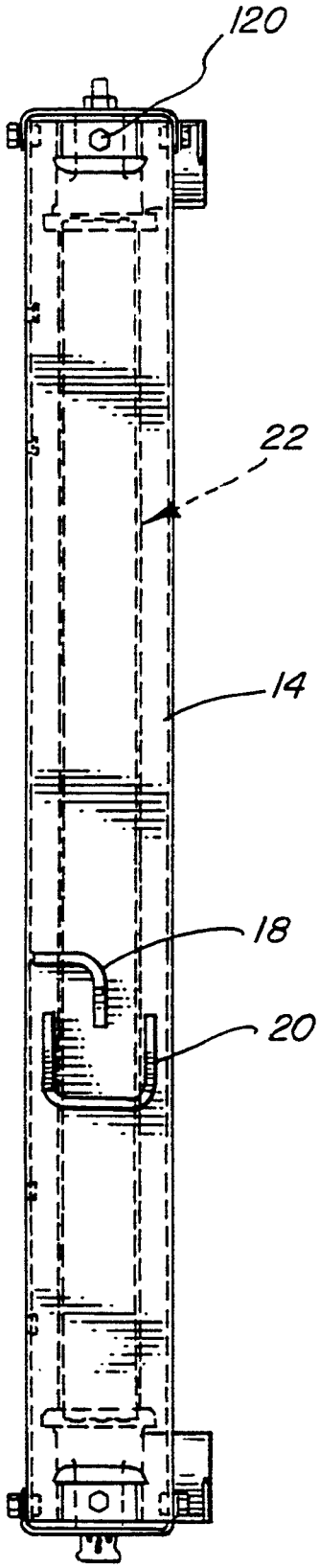
FIG. 2 is a side elevation of the radiator taken from the left of FIG. 1.

As used herein, the term substantially identical refers to the shape of the channels 10, 12, 14 16 themselves and not to any supplemental elements such as mounting brackets 18 and 20 shown welded or brazed to, for example, the side channels 14 and 16 in FIGS. 1 and 2. It is also not intended to preclude the existence of minor nonuniformities that may distinguish one channel from another and necessitated by modifications required to mount for example, other heat exchanger and/or fan shrouds to the assemblage or nonfunctional points of nonidentity.

Figure 4:
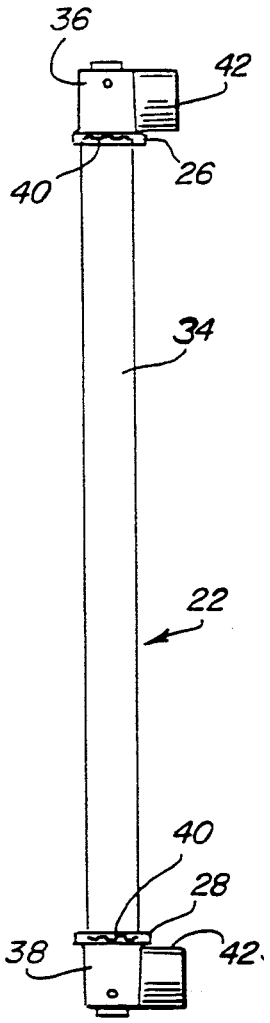
FIG. 4 is a side elevation taken from the left of FIG. 3.
Figure 3:
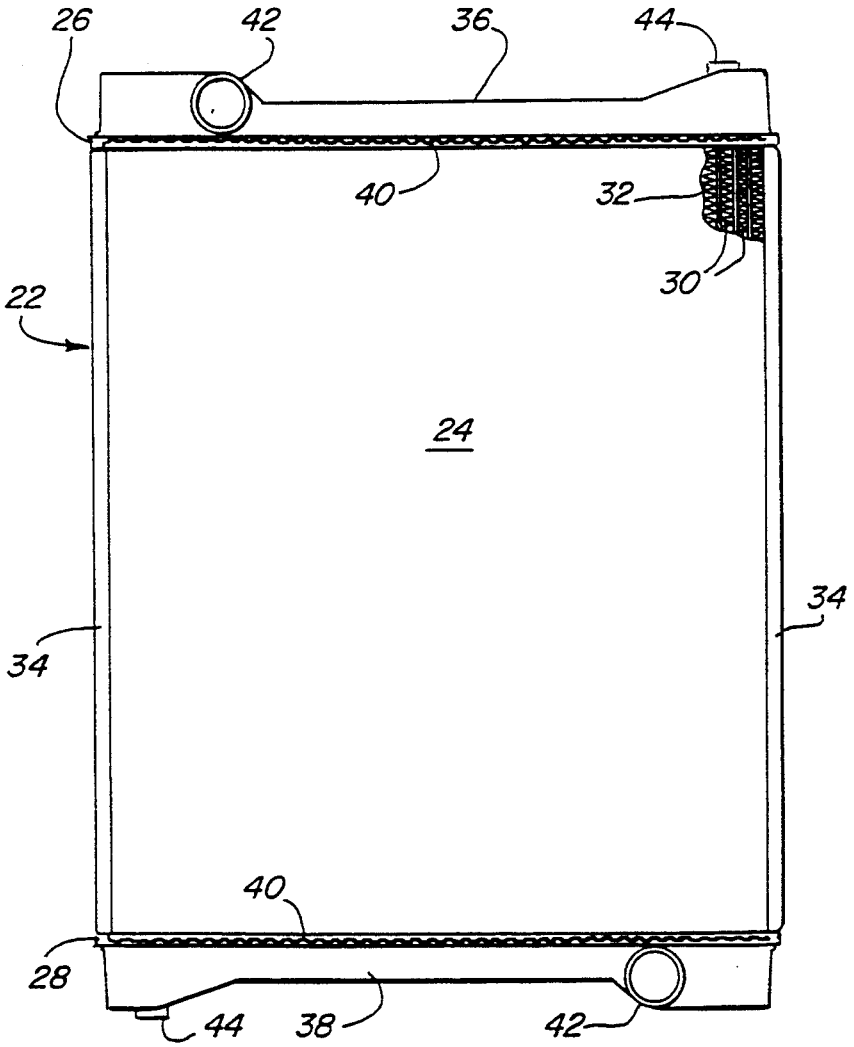
FIG. 3 is a rear elevation of a tank and core assembly used in the invention.

In any event, a tank and core assembly generally designated 22, and shown apart from the channels 10, 12, 14 and 16 in FIGS. 3 and 4, is nested in the frame defined by those channels.

As perhaps best seen in FIGS. 3 and 4, the core and tank assembly 22 is made up of a conventional core 24 which is to say the core will have a configuration of a rectangular solid. At opposite ends, the core includes headers 26 and 28 and the same are interconnected by tubes 30 which in turn are spanned by fins such as the serpentine fins 32 illustrated in FIG. 3.

Opposed sides of the core 24 have side pieces 34 which extend between and are secured in conventional ways to the headers 26 and 28.

Each header 26 and 28 has a tank 36 and 38 respectively, mounted in sealing relation thereto. In the preferred embodiment, the tanks 36 and 38 are identical and are made of plastic. They are mounted in sealing relation to their respective headers 26 and 28 by any suitable means but preferably, by means of securing strips 40 and gaskets (not shown) such as disclosed in U.S. Pat. No. 4,645,002 issued Feb. 24, 1987 to Keyzer, the details of which are herein incorporated by reference. As more fully disclosed by Keyzer, the strips 40 are easily removable so as to allow the tanks 36 and 38 to be separated from the respective headers 26 and 28 for servicing purposes or for replacement of the core 24.

Each of the tanks 36 and 38 has a transversely directed, generally cylindrical fitting or hose port 42 for connection to the cooling system of a vehicle in a conventional fashion. Optionally, additional ports 44 may also be provided.

Figure 5:
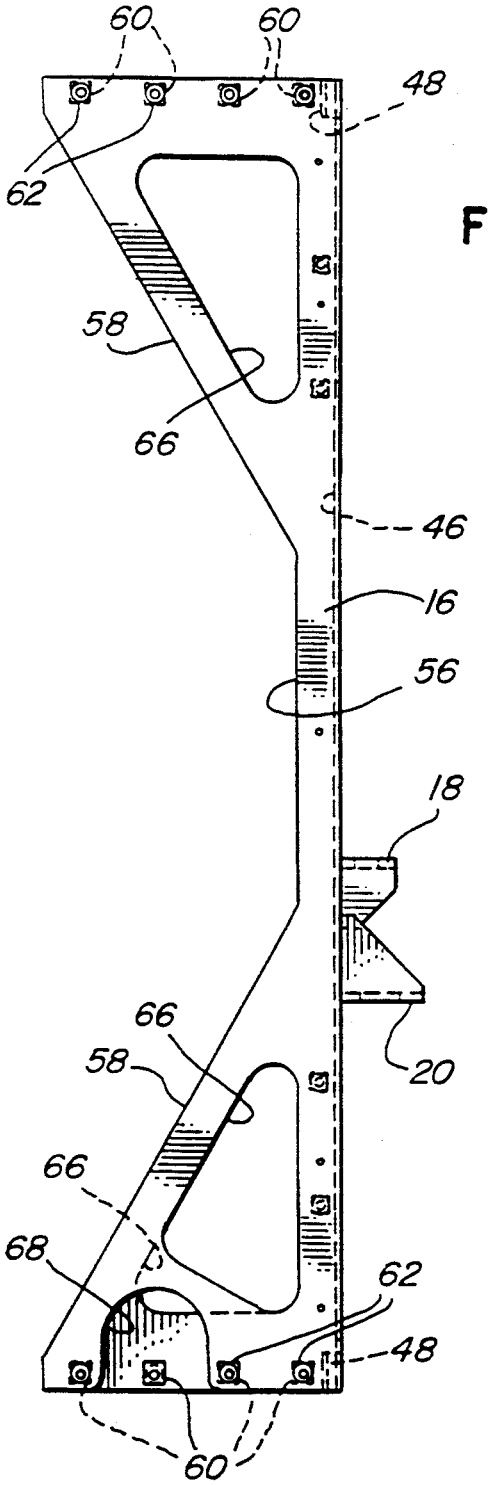
FIG. 5 is an enlarged, rear elevation of a side frame channel utilized in the invention.
Figure 6:
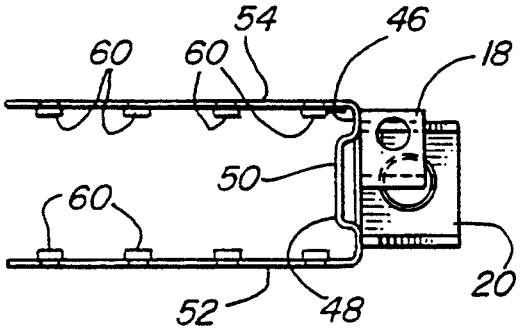
FIG. 6 is an end view of the channel of FIG. 5.

Turning now to FIGS. 5 and 6, the side channel 16 will be described. It is to be understood that the side channel 14 will be identical to the same, save for possibly the location of the mounting brackets 18, 20 mounted thereon. The channel 16 is U-shaped and includes an elongated center section 46 which is adapted to tightly embrace a corresponding side piece 34 of the core and tank assembly 22 when assembled. At each end of the center section 46 there is a short step 48 as best seen in FIG. 6. Each step 48 includes an aperture 50.

The center section 46 is flanked by two parallel legs 52 and 54 respectively. The legs 52 and 54 are elongated to have a length equal to that of the center section 46 and as can be seen in FIG. 5, near the respective centers, have sections 56 that are relatively short. From the sections 56, toward opposite ends of the channel 16, each of the legs 52 and 54 has a diagonally diverging end section 58. The diverging end sections 58 act as triangular gussets when the channels 14 and 16 are secured to the channels 10 and 12. Such securement being made by means of nuts 60 brazed to the facing surfaces of the legs 52 and 54 near the ends thereof and aligned with corresponding openings 62 through which threaded fasteners 64 (FIG. 1) may pass to threadably engage the nuts 60.

Because the gussets defined by the diagonal sections 58 overlap the core 24 as seen in FIG. 1, they are provided with triangular cutouts 66 so as to minimize the resistance to air flow through the core 24 caused by the presence of the gussets.

One end of each of the channels 14 and 16 and is provided with a generally semicylindrical relief 68 to accommodate the transverse extension of a corresponding one of the hose ports 42.

Figure 8:
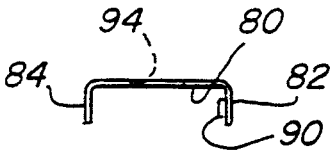
FIG. 8 is an end view of the cross member.
Figure 7:
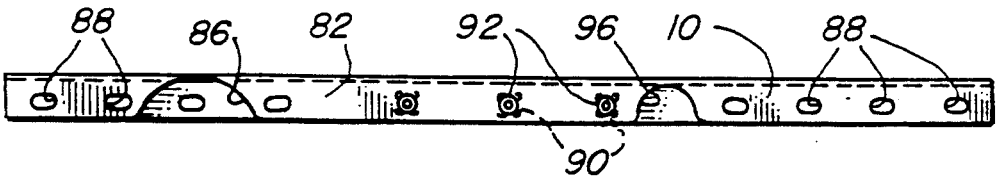
FIG. 7 is a rear elevation of a cross member.

FIGS. 7 and 8 illustrate the construction of the cross channels 10 and 12. The channel 10 is illustrated with the understanding that the channel 12 is identical thereto as mentioned previously. The same includes a central section 80 flanked by parallel legs 82 and 84. As can be seen from FIGS. 7 and 8, the length of the legs 82 and 84, that is, their extension from the central section 80, is uniform along their entire length save for the provision of one generally semicircular relief 86 which aligns with the relief 68 in the corresponding channel 14 or 16 and which is to accommodate the corresponding one of the hose ports 42.

Elongated apertures 88 are located in the legs 82 and 84 to allow the threaded fasteners 64 to be passed through the legs 82, 84 to the channels 14, 16. As illustrated in FIGS. 7 and 8, the leg 82 is provided with nuts 90 that are brazed in place over openings 92 in the leg 82. The nuts 90 may be employed to receive threaded fasteners whereby a fan shroud (not shown) is secured to the radiator.

Typically, the central section 80 may include an opening 94 to accommodate a fixture such as the fixture 44. A further relief 96 may be placed in one or both of the legs to relieve stresses or the like that occur during fabrication.

In this latter respect, for ease of fabrication as well as economy of the manufacturing process, it is preferred that the channels 10, 12, 14 and 16 be formed of sheet metal by stamping. In this way, they may be economically formed and it has been found that localized distortion as a result of the stamping process may generally be ignored.

Figure 11:
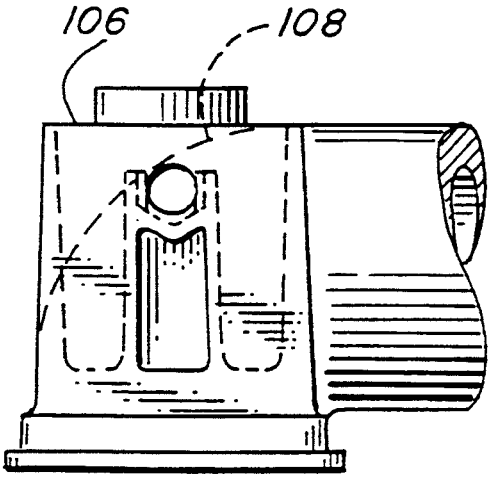
FIG. 11 is an end elevation of the tank.
Figure 10:
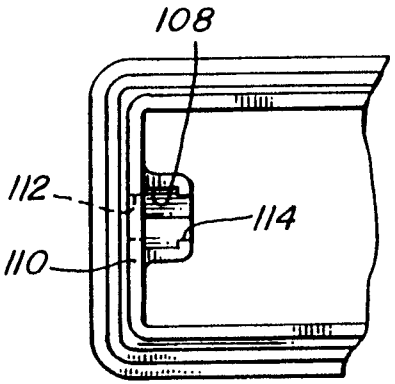
FIG. 10 is a fragmentary plan view of one end of the tank.
Figure 9:
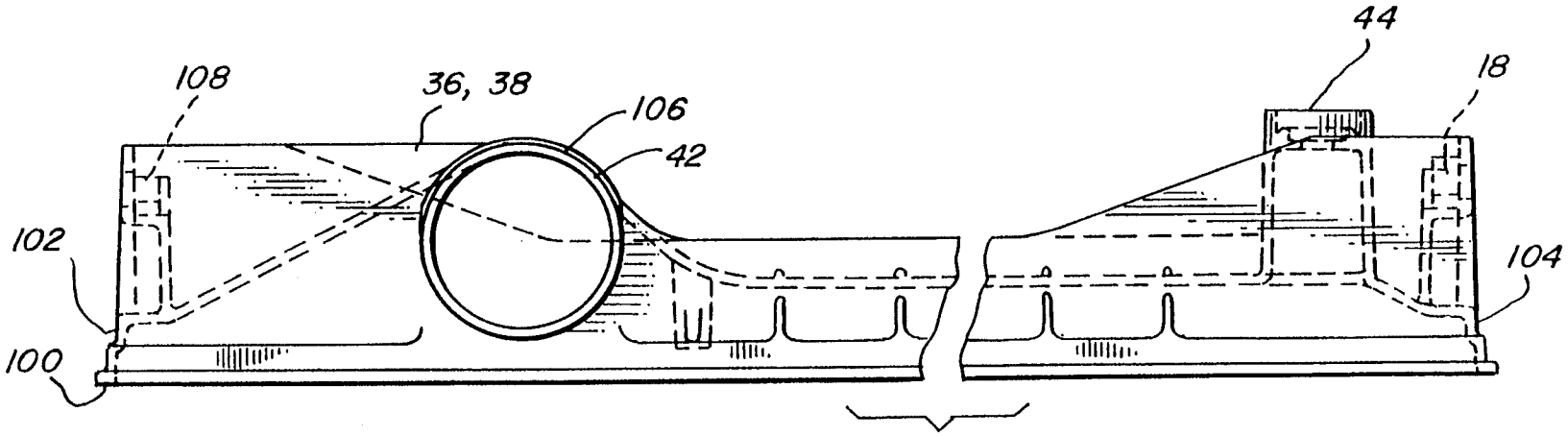
FIG. 9 is an enlarged, fragmentary rear elevation of a tank.

Turning now to FIGS. 9, 10 and 11, one of the tanks 36, 38 is illustrated. For sealing engagement with the corresponding header 26, 28, the same is provided with a peripheral, flat bottom flange 100 as is well known. At opposite ends 102, 104, of each header 36, 38, near the upper extremity 106 thereof, there is provided a corresponding nut receiving recess 108. As perhaps best seen in FIGS. 10 and 11, the corresponding end such as the end 102 illustrated includes an upstanding web 110 provided with an opening 112 that extends inwardly to the recess 108 which is slightly enlarged and which opens toward the upper surface 106. Opposite of the opening 112, the recess 108 may have a second opening 114 and as best seen in FIG. 4, the recess 108 has side walls that are in the shape of four sides of a regular hexagon. As a consequence of this construction, a hex nut may be disposed in each of the recesses 108 to receive a threaded fastener passed through the opening 112 into the nut. To the extent that such threaded fastener may be longer than the length of the recess 108, it may extend past the recess 108 after impaling a nut therein through the opening 114.

So-called crush ribs (not shown) may be located on the opposed side walls of each recess 108 so as to frictionally grip a nut when placed therein.

The heads of the threaded fasteners used for the securing purpose are illustrated in FIG. 2 at 120. The shanks of the fasteners are passed through the openings 50 in the steps 48 formed at the ends of the bights 46 of the channels 14, 16.

A core and tank assembly such as that shown at 22 is assembled in the conventional fashion. The side channels 14 and 16 are then placed about the assembly 22 such that the bights 46 of the side channels 14 and 16 are in tight engagement with corresponding side pieces 34 of the assembly 22. Nuts are disposed in the recesses 108 of the headers 36 and 38 and the threaded fasteners 120 (FIG. 2) passed through the openings 50 (FIG. 6) to be impaled on the nuts and secure the side channels 14, 16 to the tank and core assembly 22.

The cross channels 10, 12 may then be applied to the assemblage and the threaded fasteners 64 (FIG. 1) introduced through the openings 88 (FIG. 7) to be threaded into the nuts 60 on the channels 14, 16 to hold the entire assembly together.

It will be appreciated from the foregoing that the support structure for the tank and core assembly 22 provided by the use of the channels 10, 12, 14 and 16 is low cost and compact. It is readily susceptible to mounting on rubber grommets or the like in the environment of intended use to isolate the radiator from vibrational loading and the side channels 14 and 16, by reason of their abutment with the side pieces 34, support the core 24 to prevent pressure cycle failure.

The use of substantially identical cross channels and substantially identical side channels provides a strong frame having four components but only of two different configurations to minimize tooling. The arrangement is such that maximum design flexibility is obtained since only relatively simple fixtures need be employed to relocate mounting brackets such as the brackets 18 and 20 as desired to accommodate various mount locations in a vehicle or to provide variable radiator face areas to accommodate various performance requirements.

Manufacturing is simple, especially when considered in the light of the number of bolts used in a conventionally bolted radiator and the entire structure is readily disassembled for servicing purposes.

I claim:

1. A heavy duty radiator comprising:

a core and tank structure including a heat exchanger core having the shape of a rectangular solid, a pair of spaced headers, one on each end of said core, and interconnected by tubes which in turn are spanned by serpentine fins a pair of spaced side pieces one on each side of said core and extending between and secured to said headers and a pair of tanks, one secured to each of said headers;

a separate rectangular frame for said tank and core assembly, said frame comprising two each of first and second channels with the first channels being substantially identical and the second channels being substantially identical, the first channels being disposed at opposite ends of said tank and core assembly and encompassing corresponding ones of said tanks, the second channels fitting about said sides and embracing the corresponding side pieces to provide pressure resistance to the sides of said core;

first fasteners securing said second channels to said first channels; and second fasteners securing said second channels to said tanks.

2. The radiator of claim 1 wherein gussets integral with at least two of said channels are disposed at the corners of said frame and interconnect the respective channels at each said corner.

3. The radiator of claim 1 wherein said channels are stamped sheet metal.

4. The radiator of claim 1 wherein said tanks are identical.

5. A heavy duty radiator comprising:

a core and tank structure including a heat exchanger core having the shape of a rectangular solid, a pair of spaced headers, one on each end of said core, and interconnected by tubes which in turn are spanned by serpentine fins, a pair of spaced side pieces one on each side of said core and extending between and secured to said headers and a pair of tanks, one secured to each of said headers;

a separate rectangular frame for said tank and core assembly, said frame comprising two each of first and second channels with the first channels being substantially identical and the second channels being substantially identical, the first channels being disposed at opposite ends of said tank and core assembly and encompassing corresponding ones of said tanks, the second channels fitting about said sides and embracing the corresponding side pieces to provide pressure resistance to the sides of said core;

first fasteners securing said second channels to said first channels; and second fasteners securing said second channels to said tanks.

6. The radiator of claim 5 wherein said gussets have open centers to minimize obstruction to air flow through said core.

7. The radiator of claim 5 wherein said second fasteners are threaded fasteners extending through said second channels to the ends of said tanks.

8. A heavy duty radiator comprising:

a core and tank structure including a heat exchanger core having the shape of a rectangular solid, a pair of spaced headers, one on each end of said core, and interconnected by tubes which in turn are spanned by serpentine fins, a pair of spaced side pieces one on each side of said core and extending between and secured to said headers and a pair of tanks, one secured to each of said headers;

a separate rectangular frame for said tank and core assembly, said frame comprising two each of first and second channels with the first channels being substantially identical and the second channels being substantially identical, the first channels being disposed at opposite ends of said tank and core assembly and encompassing corresponding ones of said tanks, the second channels fitting about said sides and embracing the corresponding side pieces to provide pressure resistance to the sides of said core;

first fasteners securing said second channels to said first channels; and second fasteners securing said second channels to said tanks.

9. A heavy duty radiator comprising:

a core and tank structure including a heat exchanger core having the shape of a rectangular solid, a pair of spaced headers, one on each end of said core, and interconnected by tubes which in turn are spanned by serpentine fins, a pair of spaced side pieces one on each side of said core and extending between and secured to said headers and a pair of tanks, one secured to each of said headers;

a separate rectangular frame for said tank and core assembly, said frame comprising two each of first and second channels with the first channels being substantially identical and the second channels being substantially identical, the first channels being disposed at opposite ends of said tank and core assembly and encompassing corresponding ones of said tanks, the second channels fitting about said sides and embracing the corresponding side pieces to provide pressure resistance to the sides of said core;

first fasteners securing said second channels to said first channels; and second fasteners securing said second channels to said tanks.

10. The heavy duty radiator of claim 1 wherein said tanks include ends having recesses with a first opening open towards a surface of the tank and a second opening extending into the recess through a side thereof;

said second fasteners being threaded fasteners including parts disposed in said recess through said first openings thereof and other parts extending through said second openings.

11. The heavy duty radiator of claim 10 wherein said first parts are nuts and said second part are threaded shafts;

said tanks further being made of plastic with said recesses being molded therein.

* * * * *